United States Patent [19]

Gemma

[11] Patent Number: 4,657,317

[45] Date of Patent: Apr. 14, 1987

[54] STORAGE ASSEMBLY

[76] Inventor: Joseph A. Gemma, 1394 Beattie Ct., San Jose, Calif. 95120

[21] Appl. No.: 844,576

[22] Filed: Mar. 27, 1986

[51] Int. Cl.[4] ..... A47B 53/00

[52] U.S. Cl. ..... 312/198; 211/162; 312/286

[58] Field of Search ..... 312/198, 203, 286, 348, 312/330 R; 211/162

[56] References Cited

U.S. PATENT DOCUMENTS

| | | | |
|---|---|---|---|
| 314,500 | 3/1885 | Wiles | 211/162 |
| 435,974 | 9/1890 | Montigny . | |
| 455,604 | 7/1891 | Bahr . | |
| 504,782 | 9/1896 | Hine | 312/348 |
| 559,068 | 4/1896 | Vess et al. . | |
| 637,361 | 11/1899 | Suters . | |
| 917,105 | 4/1909 | McCabe | 211/162 |
| 1,007,052 | 10/1911 | Batts . | |
| 1,853,061 | 4/1932 | Judelson | 211/162 |
| 2,372,249 | 3/1945 | Bruen | 312/198 |
| 2,608,305 | 8/1952 | Sager | 211/162 |
| 2,872,048 | 2/1959 | Cooper | 312/286 |
| 3,732,633 | 5/1973 | Margolis et al. . | |
| 3,900,108 | 8/1975 | Rotterman et al. . | |
| 3,912,086 | 10/1975 | de Bruyn . | |
| 4,008,807 | 2/1977 | Phillips | 211/162 |

*Primary Examiner*—Kenneth J. Dorner
*Assistant Examiner*—Joseph Falk
*Attorney, Agent, or Firm*—Flehr, Hohbach, Test, Albritton & Herbert

[57] ABSTRACT

A modular compact storage assembly includes storage cabinets containing a number of storage panels each equipped with means for supporting a number of articles therein. The storage panel assemblies are hung from tracks and guided at the bottom so as to permit them to be moved between stored and withdrawn positions. In the withdrawn position, the storage panels may be substantially entirely outside of their associated cabinet while a portion protrudes into the cabinet to inhibit the panel from swaying laterally under such circumstances. According to another embodiment, a pair of storage cabinets employs a common grouping of tracks which are shared by pairs of storage panel assemblies taken respectively from both cabinets. According to a further embodiment, the storage panel assemblies can be movable from a stored to a withdrawn position from either the front or the back of the cabinet.

9 Claims, 20 Drawing Figures

FIG_9
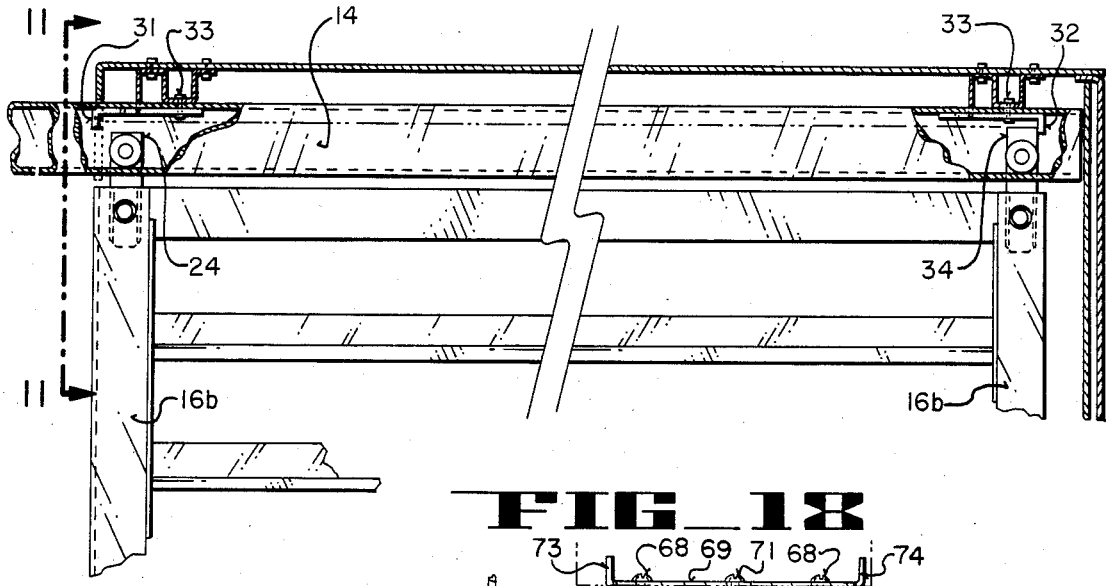
FIG_18
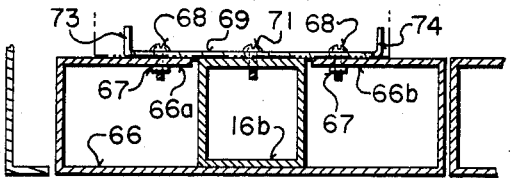
FIG_10
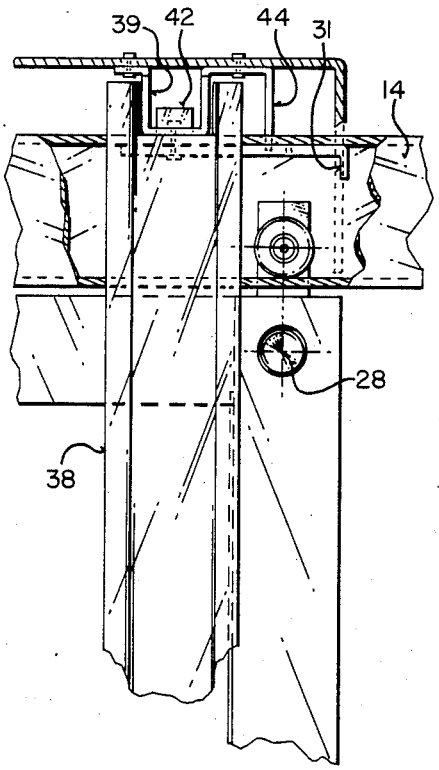
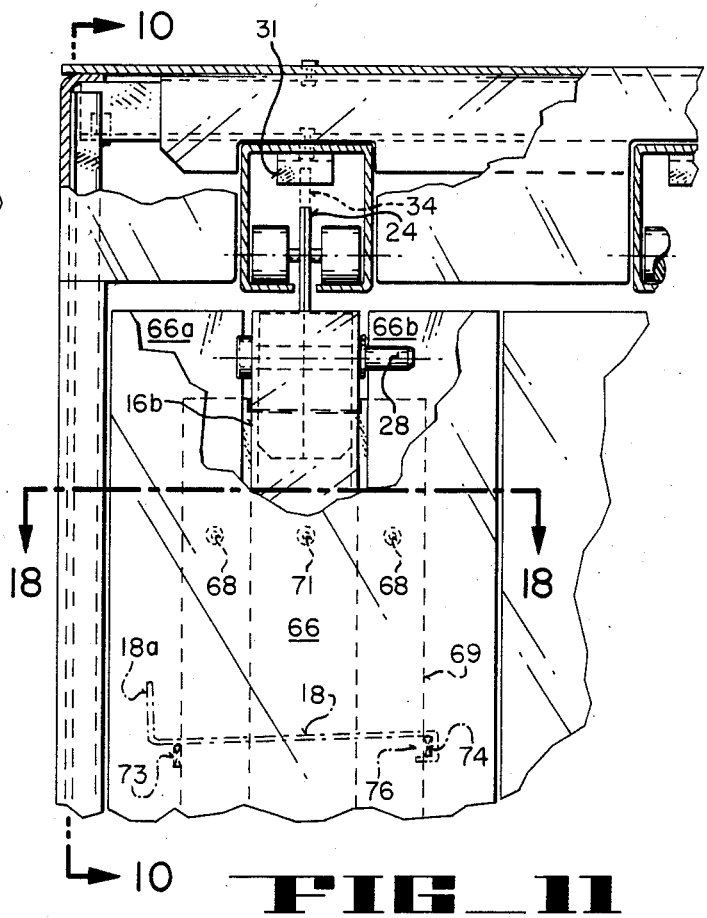
FIG_11

FIG_12
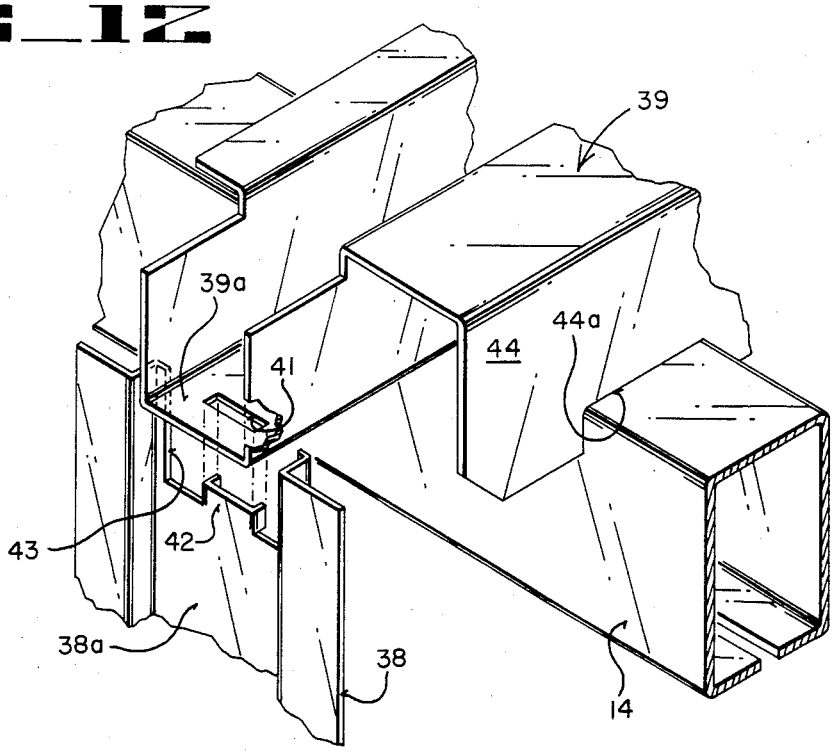
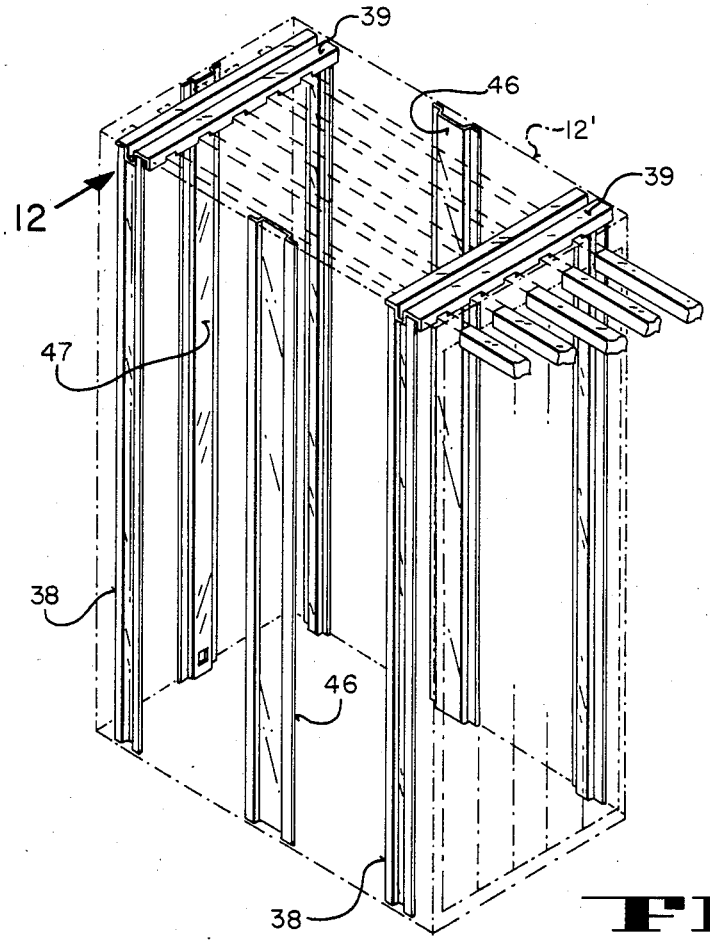
FIG_13

FIG_14
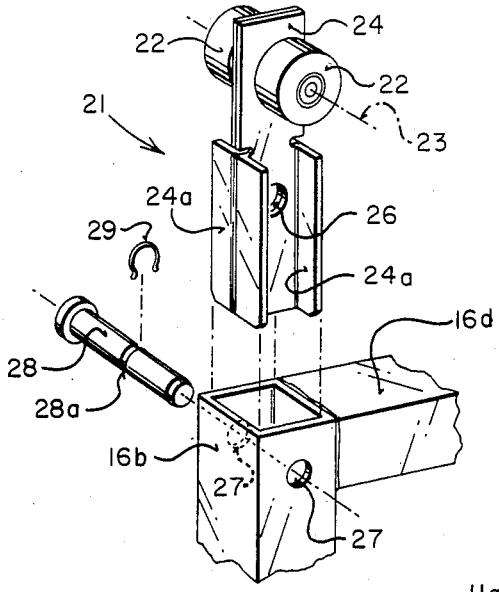
FIG_16
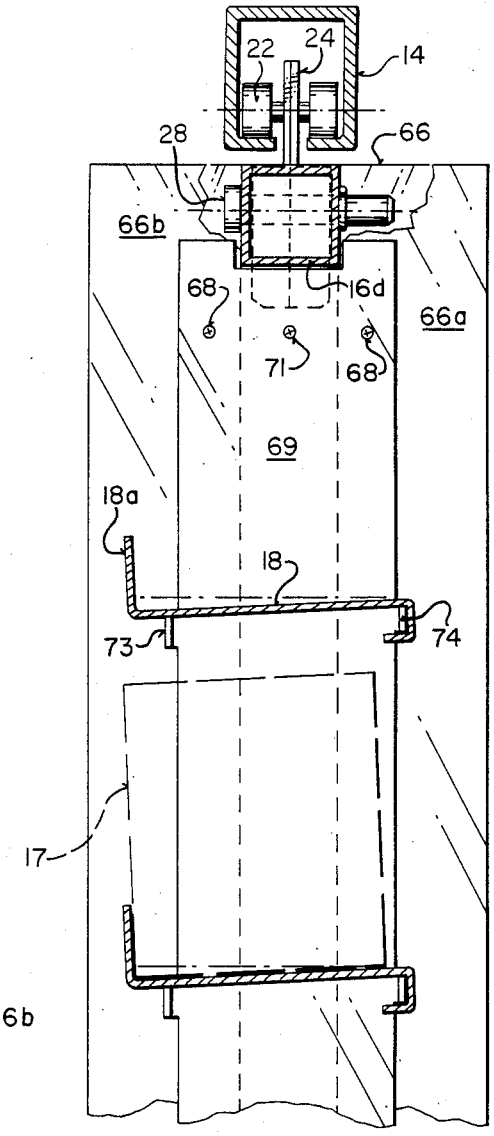
FIG 15
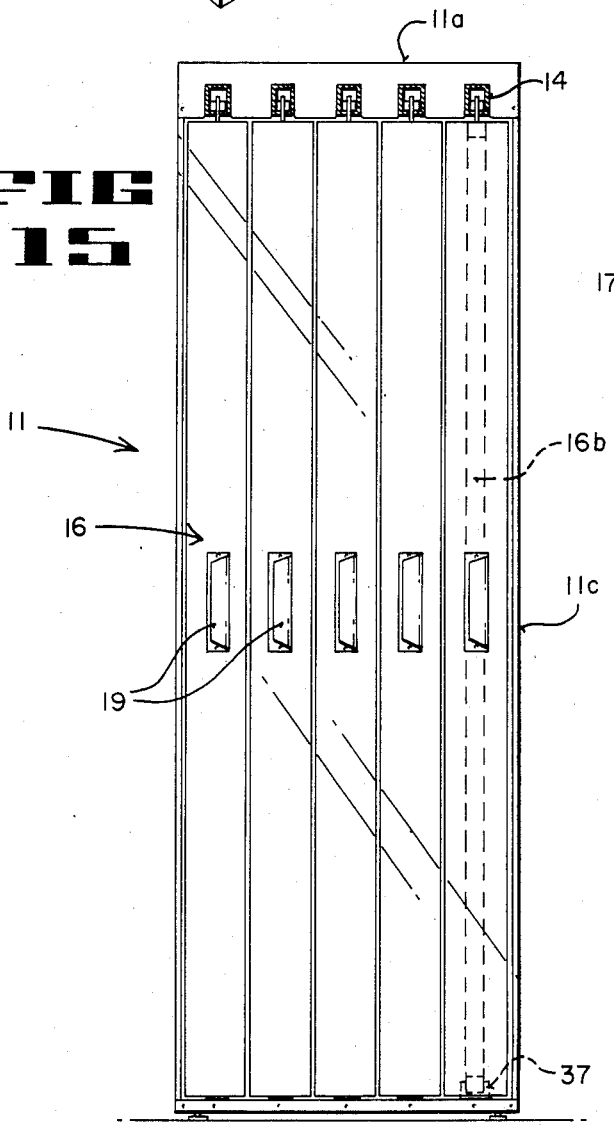
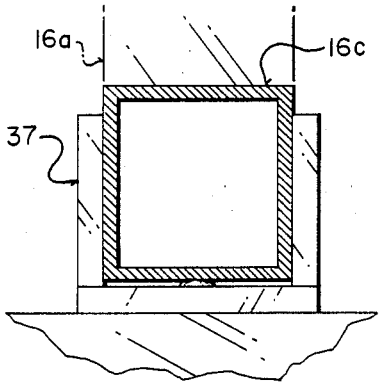
FIG_17

STORAGE ASSEMBLY

This invention pertains to a storage assembly particularly useful in storing catalogued articles such as microfilm and the like. More particularly, this invention pertains to a storage assembly characterized by a number of storage panels hung from tracks to permit the panels to be moved between a stored and withdrawn position.

As noted above, the present invention is particularly useful in conjunction with storing small boxes of microfilm. Storage for articles of the kind described, should provide a system which makes it convenient for a clerk to obtain and replace articles in storage so as to ensure against loss of the stored articles. A storage system as described herein provides an extremely convenient arrangement for storing articles of the kind described in a manner permitting prompt location of a given article and easy replacement thereof to storage.

SUMMARY OF THE INVENTION AND OBJECTS

In general a storage assembly as herein disclosed includes a protective cabinet adapted to be self standing on a support surface. A plurality of substantially parallel tracks carried by and adjacent the top of the cabinet protrude forwardly beyond the front of the cabinet whereby a plurality of storage panel assemblies carried by the tracks move individually therealong between stored and withdrawn positions. Means are further provided for supporting the outer ends of the tracks so as to support the panel assemblies as they are withdrawn. The degree to which the tracks protrude substantially corresponds to the width of the panel assemblies carried thereon so as to substantially fully expose the sides of the storage panel assemblies. In this manner, access is readily provided to articles carried by the withdrawn panel.

According to one embodiment of the invention, each of a number of pairs of storage panel assemblies from each of two cabinets share a common track on which the storage panels move.

According to another embodiment of the invention, a number of substantially parallel tracks extend in opposite directions from the front and back of the storage cabinet so that an associated storage panel assembly can be rollably carried therealong to move from a stored position within the cabinet to a withdrawn position at either the front or the back of the cabinet.

In general it is an object of the present invention to provide an improved storage assembly.

It is another object of the invention to provide an improved storage assembly which lends itself to modular usage.

Another object of the invention is to provide a storage assembly in which access to the stored materials can be obtained from the front or the back of a storage cabinet.

Yet another object of the invention is to provide a storage assembly characterized by movable storage panels formed with readily removable shelving to accommodate different sizes of articles carried thereon.

The foregoing and other objects of the invention will become more readily evident from the following detailed description of preferred embodiments, when considered in conjunction with the drawings.

BRIEF DESCRIPTION OF THE DRAWINGS

FIG. 9 shows an enlarged diagrammatic elevation section view showing the upper end of a storage panel assembly for use in conjunctin with the embodiments shown in FIGS. 1, 2 or 3;

FIG. 10 shows an enlarged detail view in section taken along the line 10—10 of FIG. 11;

FIG. 11 shows an enlarged elevation section view with portions broken away taken along the line 11—11 of FIG. 9;

FIG. 12 shows a diagrammatic perspective exploded view of an interconnection made between portions of reinforcing members within a cabinet structure as shown in FIG. 13;

FIG. 13 shows a diagrammatic perspective view illustrating reinforcement of the sidewalls and top of a cabinet according to the invention;

FIG. 14 shows a diagrammatic perspective exploded view of a hanger assembly for supporting the storage panel assemblies;

FIG. 15 shows a front elevation view of a storage cabinet assembly;

FIG. 16 shows, in enlarged detail, an elevation section view of a portion of a panel assembly;

FIG. 17 shows, in enlarged detail, an elevation section view of a guide unit taken along line 17—17 of FIG. 7 for guiding the bottom of a storage panel assembly; and FIG. 18 shows a diagrammatic plan view of the front of a panel assembly showing a door edge cover.

DETAILED DESCRIPTION OF PREFERRED EMBODIMENTS

Figure 1:
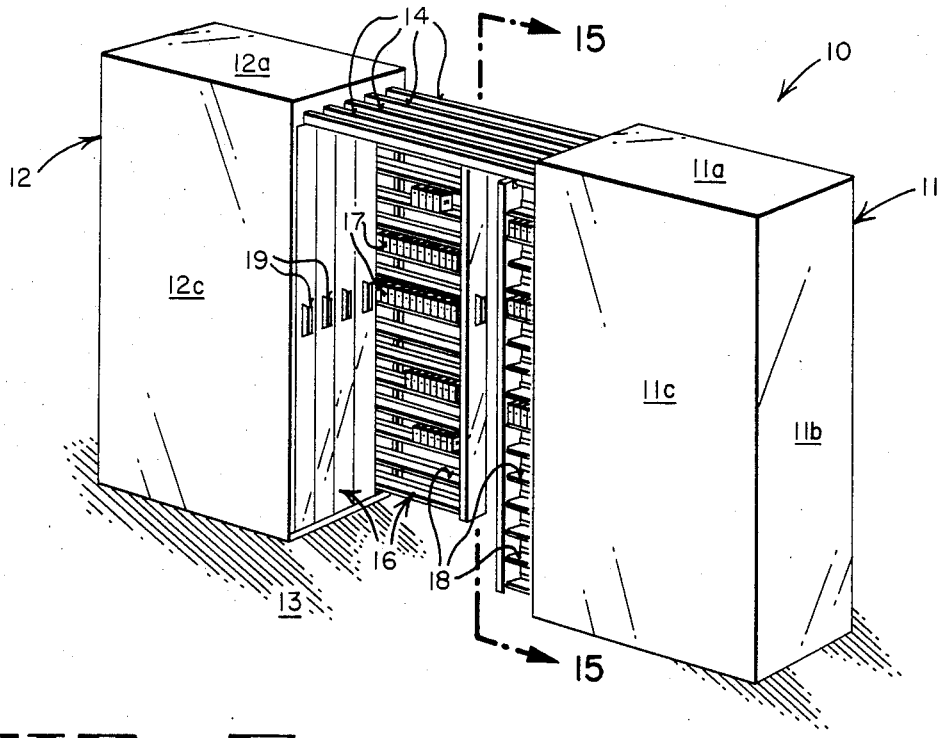
FIG. 1 shows a diagrammatic perspective view of a pair of storage cabinet assemblies with two storage panels withdrawn, according to the invention.
Figure 2:
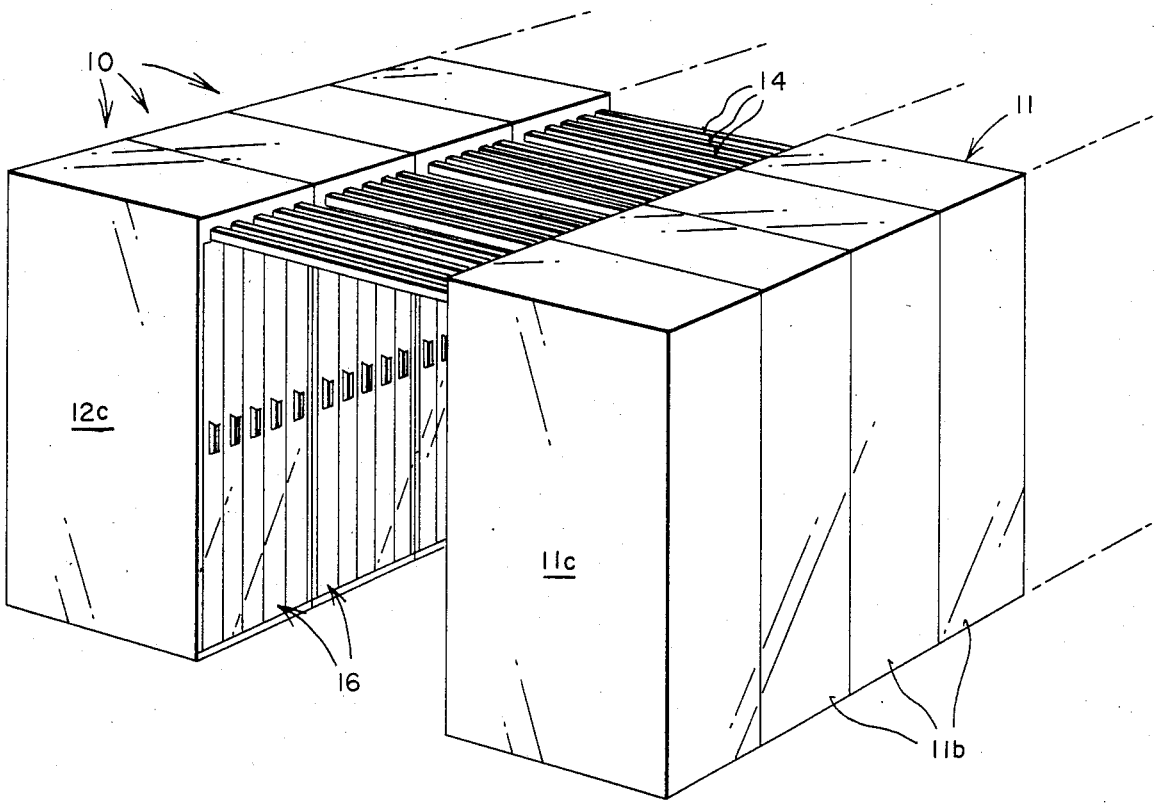
FIG. 2 shows a number of storage cabinet assemblies arranged in modular form in side-by-side relation, according to the invention.

FIG. 1 shows a storage assembly 10 including a pair of protective cabinets 11, 12. Each cabinet 11, 12 is adapted to be free standing on a support surface such as floor 13. Cabinets 11, 12 respectively include a top panel 11*a*, 12*a*, a back such as panel 11*b*, two sides 11*c*, 12*c* and a generally open front. The fronts of cabinets 11, 12 are disposed in confronting relation as shown in FIG. 1. A plurality of substantially parallel tracks 14 extending between the two cabinets 11, 12 are carried by and adjacent the tops of cabinets 11, 12 and extend fully into each cabinet.

A plurality of storage panel assemblies 16 travel on rollers along tracks 14 to move individually between stored and withdrawn positions. Accordingly, as noted, each track 14 is shared by a storage panel assembly 16 from both cabinets 11, 12.

The spacing between cabinets 11, 12 is sufficient to permit a panel assembly 16 to be withdrawn to a degree substantially fully exposing the articles carried by same. As shown in FIG. 1, small boxes 17 of microfilm are shown carried on shelves 18 of panel assemblies 16.

Means for withdrawing a given panel assembly 16 includes the grip 19 carried on a face plate portion of panel assembly 16.

Figure 7:
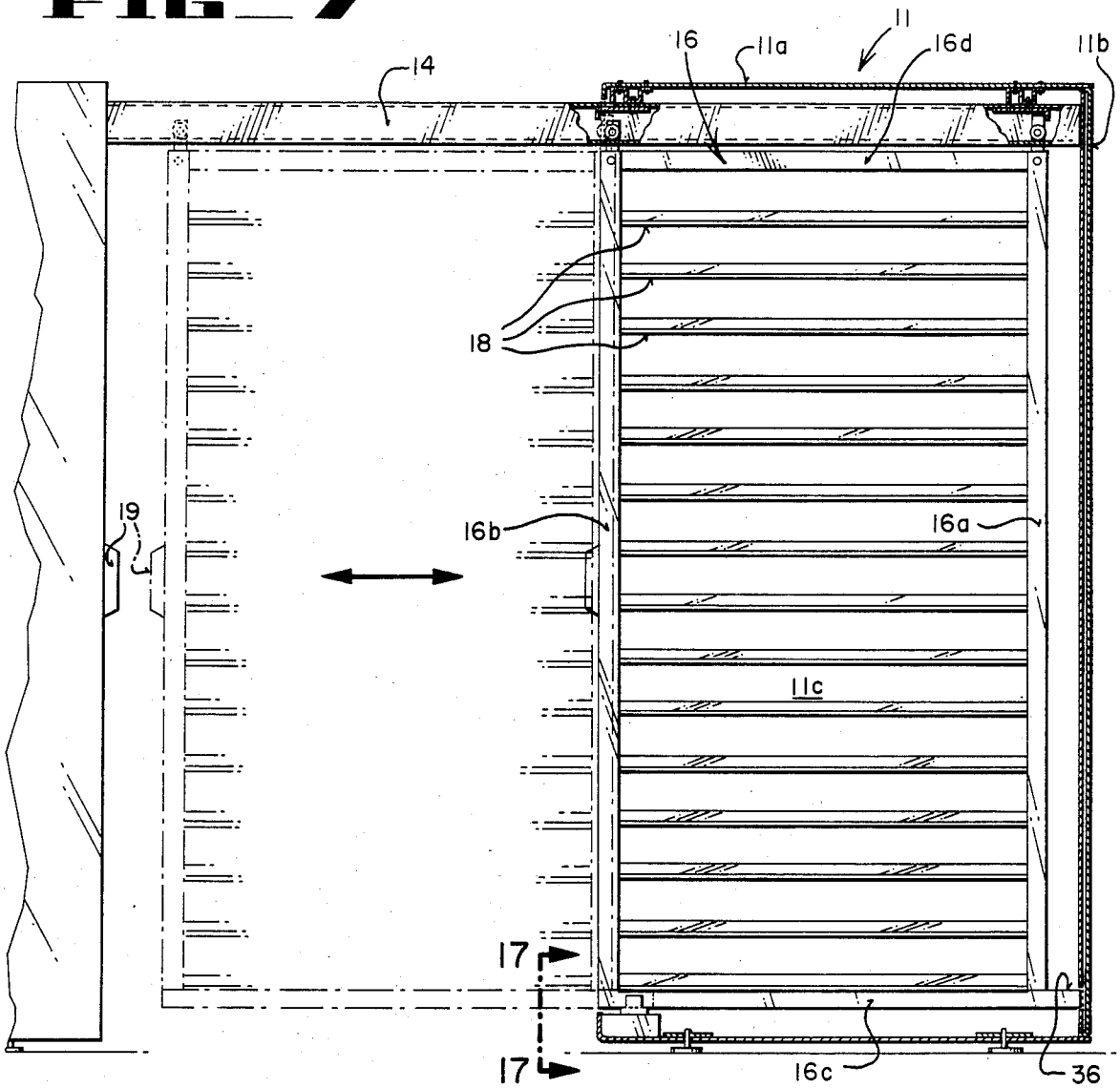
FIG. 7 shows a diagrammatic elevation section view of a storage assembly according to the embodiment shown in FIG. 2.

As shown in FIG. 7, each storage panel assembly 16 includes a rigid rectangular frame comprised of a pair of hollow tubular uprights 16*a*, 16*b* of rectangular cross section and a pair of transverse members 16*c*, 16*d* joining uprights 16*a*, 16*b*. Uprights 16*a*, 16*b* are each open at their upper ends to receive a hanger assembly 21 inserted into each of the open upper ends of uprights 16*a*, 16*b*, as shown best in FIG. 14.

Hanger assembly 21 carries a pair of rollers 22 disposed on opposite sides of a pair of hanger webs 24 and supported for rotation upon an axle 23 extending between the two webs 24.

The lower end of webs 24 includes side portions 24*a* disposed substantially normal to the plane of webs 24 and dimensioned to snugly fit within the open upper end of upright 16*b*, as shown. In addition, means are provided for readily releasably coupling hanger assemblies 21 to uprights 16*a*, 16*b*.

A pair of aligned openings 27 formed through uprights 16*a*, 16*b* adjacent the upper ends thereof are adapted to be aligned with openings 26 formed through webs 24. When so aligned, a retaining pin 28 can be inserted through openings 27, 26 to retain hanger assembly 21. Retaining pin 28 includes a groove 28*a* adapted to be disposed on the near side of member 16*b* (as shown in FIG. 14) after having been inserted through openings 26, 27 whereby a snap ring 29 will retain pin 28 from becoming released.

As shown in FIGS. 7, 9 and 11 means carried by tracks 14 serve to prevent each panel assembly from fully leaving its associated cabinet when withdrawn and also serve to prevent the panel assemby from engaging the back wall of its associated cabinet when returned to its stored position.

Accordingly, fixed stops 31, 32 carried within tracks 14 by means of bolts 33 provide a rigid depending lip hanging downwardly into the interior of tracks 14 for engaging the side edge of the upper end of an extended hanger web 34 while permitting the upper end of hanger web 24 to pass beneath both stops.

Accordingly, as the framework which forms storage panel assembly 16 moves to the left (as shown in FIG. 9), engagement between hanger web extension 34 and the downwardly depending lip of fixed stop 31 will define the degree to which panel assembly 16 can be withdrawn. As shown, panel assemblies 16 can be withdrawn to a degree corresponding substantially to the full width thereof.

Figure 8:
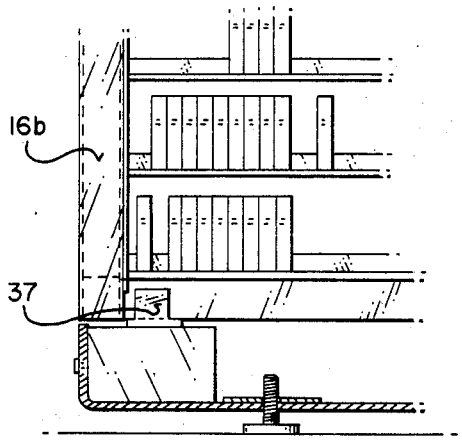
FIGS. 8 and 8A show enlarged elevation detail views, in section, showing the manner of guiding and retaining a storage panel assembly as it moves between stored and withdrawn positions according to the invention.
Figure 8A:
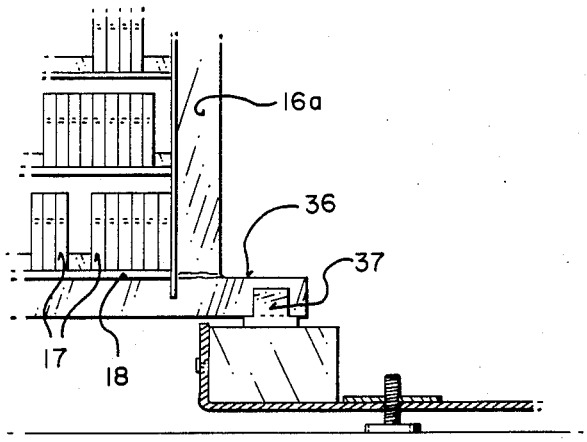

Member 16*c* provides a bottom edge to the storage panel assembly. As noted particularly in FIGS. 7 and 8A, member 16*c* includes a short extension portion 36 which extends rearwardly along the bottom edge of the frame formed by members 16*a*–16*d*.

Means for guiding the bottom edge of each panel assembly during movement between stored and withdrawn positions includes member 16*c* and rearwardly protruding extension 36. Thus, panel assembly 16 remains engaged with the bifurcated guide 37 (FIGS. 8*a*, 17) so as to prevent panel 16 from swaing laterally while substantially fully withdrawn, and to insure that each panel 16 is easily returned to its proper storage space.

It will be readily evident that by fully withdrawing a given panel assembly 16 beyond the limits of the edge guide 37, the panel 16 would be in a position to sway laterally thereby making it more difficult to return the panel assembly to its assigned location without contacting adjacent panels and possibly chipping paint therefrom and the like. This swaying condition would also cause the handling of articles on the lower shelves to be more difficult.

As thus arranged, fixed stops 31, 32 carried by tracks 14 serve to arrest each panel assembly 16 at both ends of its travel in a manner preventing panel assemblies 16 from fully leaving their associated guiding means 37 when withdrawn while preventing the rearwardly extending portion 36 from engaging the back wall of its associated cabinet when stored.

A cabinet construction as described above contains internal reinforcing members as shown best in FIGS. 12 and 13. Thus, the exterior surfaces of cabinet 12 (for example) shown in phantom lines 12' are reinforced from within by elongate rigid struts, hereinafter referred to as "hat" sections 38. A pair of transverse "hat" sections 39 join the top ends of "hat" sections 38 as shown in FIG. 12.

Thus, transverse "hat" sections 39 include a channel portion 39, and the upper end of "hat" section 38 also includes a channel portion 38*a*.

The outer ends of channel 39*a* include a rectangular transverse opening 41. The upper end of channel 38*a* of strut 38 includes a relieved portion 43 formed to include an upwardly extending U-shaped protrusion or key 42 for engaging openly 41 as channel 39*a* is lowered downwardly into relieved portion 43.

Transverse "hat" sections 39 include a downwardly depending track alignment guide panel 44 formed with laterally spaced notches 44*a* for receiving associated tracks 14 therein.

To provide extra strength to the cabinet additional struts or "hat" sections 46 are secured to the side walls and a "hat" section 47 is secured to the back wall of the cabinet.

Uprights 16*a*, 16*b* of the frame of panel assembly 16 carry means for supporting a number of readily removable shelves 18, as well as a decorative covering for the outer edge of each panel assembly 16. Thus, as shown in FIGS. 11, 16 and 18 a frame cover 66 extends across the leading or outermost upright 16*b* of the rectangular frame. Cover 66 is folded rearwardly and then folded again to form mounting panels 66*a*, 66*b*. So-called "pim" nuts 67 are pressed in known manner into the back surface of mounting panels 66*a*, 66*b* for receiving screws 68 therein, and disposed in alignment with screw holes formed through panels 66*a*, 66*b*.

A shelf mounting panel 69 lies flat against and, by means of screws 68, joins panels 66*a*, 66*b* to capture upright 16*b* within cover 66. Means for holding cover 66 from moving along upright 16*b* includes a column of self-tapping screws 71 passing through panel 69 and into upright 16*b*. In addition to screws 71, the grip 19 is attached to upright 16*b* by screws 72 which extend through a base portion of the grip and the front of cover 66 into upright 16*b* to further support cover 66 on upright 16*b*.

Mounting panel 69 carries means for engaging and supporting each of a number of shelves. Thus, the side edges of panels 69 include short tabs 73, 74 bent in a common direction substantially normal to the plane of panel 69.

Tabs 74 along one edge are disposed slightly higher than tabs 73 along the other so as to tip shelves 18 backwardly when mounted thereon. Finally, one edge of each shelf 18 is folded down and back to form a slot 76 for engaging tabs 74 while the back of the shelf rests freely upon tabs 73. Shelves 18 include an upwardly bent flange 18*a* for the back of each box 77 to rest against (FIG. 16) when carried by the shelf.

Shelves 18 can be readily removed as desired so as to accommodate taller articles to be stored in the panel assemblies 16.

Figure 4:
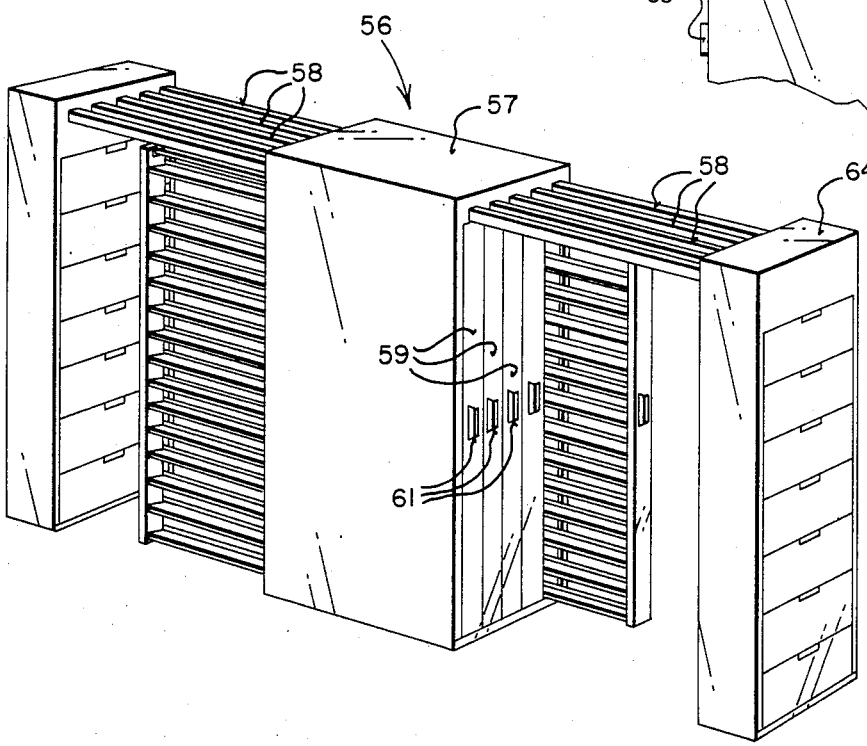
FIG. 4 shows a diagrammatic perspective view of a storage cabinet assembly in which storage panels thereof can be withdrawn either to the front or the back according to another embodiment of the invention.
Figure 4A:
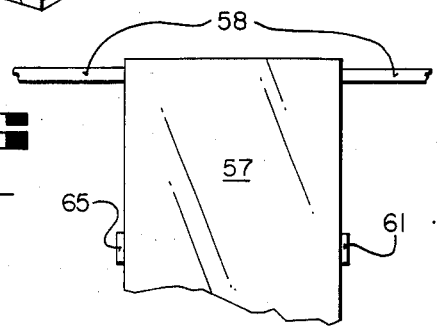
FIG. 4*a* shows a diagrammatic side elevation view of the cabinet portion of the storage assembly shown in FIG. 4.

The other upright 16*a* of the frame need not employ a cover, such as cover 66, since a shelf mounting panel corresponding to panel 69 can be screwed directly into upright 16*a*. However, in the embodiment of FIG. 4 both uprights 16*a*, 16*b* will be covered as above described.

Figure 3:
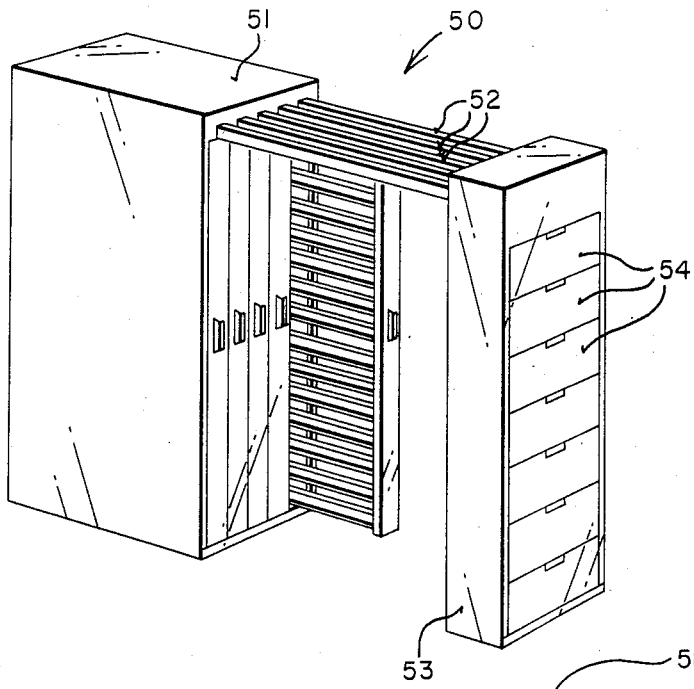
FIG. 3 shows a storage cabinet assembly with one storage panel assembly partially withdrawn for clarity, according to another embodiment of the invention.

According to another embodiment of the invention as shown in FIG. 3, a storage assembly 50 includes a single storage cabinet 51 constructed as above described. Means for supporting the outer ends of roller tracks 52 includes an upstanding storage cabinet 53 of a type employing conventional filing drawers.

As thus arranged, the free standing assembly 50 can preferably be disposed with its back to a wall while permitting conventional storage to be achieved by use of filing drawers 54.

Yet another embodiment of the invention is shown in FIGS. 4, 4A, 5 and 6. A single unit storage assembly 56 includes a single protective cabinet 57 having top, bottom and side walls and an open front and back. A plurality of substantially parallel tracks 58 carried by and adjacent the top wall of cabinet 57 as above described serve to extend in opposite directions from the front and back of cabinet 57. A plurality of storage panel assemblies 59 generally as above described serve to carry articles therein.

Storage panel assemblies 59 are rollably carried by tracks 58 to move individually therealong from a stored position within cabinet 57 to a withdrawn position at either the front or the back of cabinet 57.

Storage panel assemblies 59 include front and back face plates as above described adapted to form a portion of the front and back of the storage assembly 56. In addition, detent means serve to retain each panel assembly 59 within cabinet 57 with the front and back face plates thereof disposed in an aligned relation.

Finally, means, such as the grips 61 or handles, carried on both the front and back edges of storage panel assemblies 59 permit panel assemblies 59 to be withdrawn from cabinet 57 from either the front or the back of the cabinet.

Figure 5:
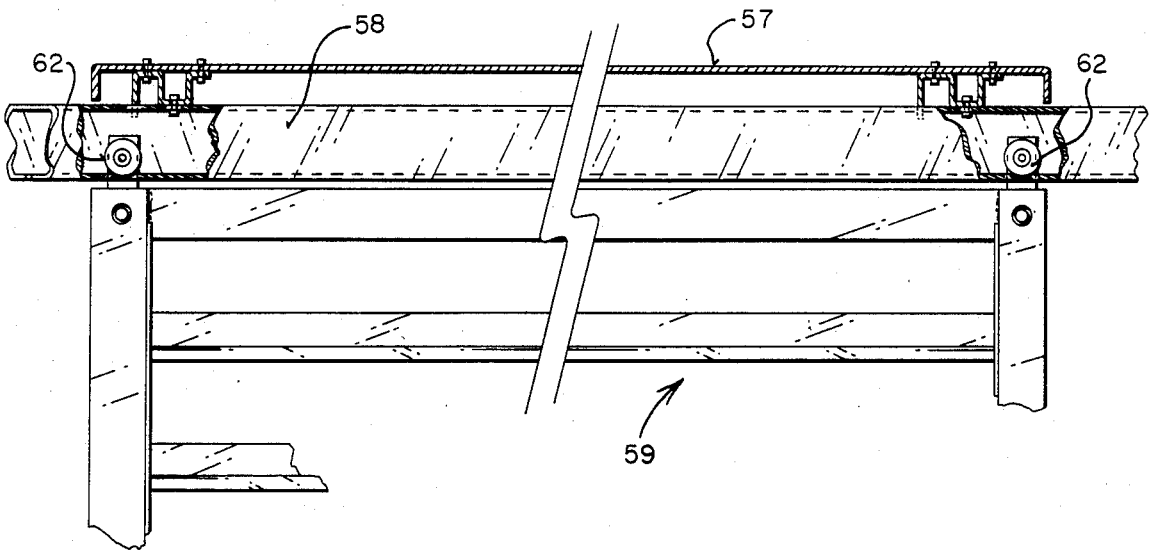
FIG. 5 shows a diagrammatic elevation view in enlarged detail with portions broken away for clarity showing a support track and storage panel assembly frame for use in conjunction with the embodiment shown in FIG. 4.
Figure 6:
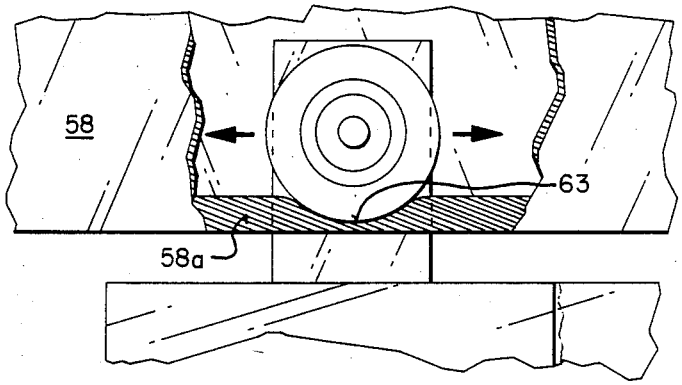
FIG. 6 shows an enlarged diagrammatic elevation view, with portions broken away, of a detent detail of the track structure shown in FIG. 5.

Accordingly, as shown in FIGS. 5 and 6, rollers 62 as described above with respect to the hanger assemblies shown in FIG. 14 ride along the inside bottom surface of track 58.

Means for retaining each storage panel assembly 59 within cabinet 57 in a manner maintaining the front and back of the cabinet flush when all panels are stored, includes the detent 63 formed in the bottom 58*a* of track 58. Detents 63 are spaced a distance coequal to the spacing between rollers 62. Thus, as rollers 62 move into their associated storage cabinets, the storage panel assembly will be retained therein.

Finally, means for supporting the outer ends of tracks 58 includes a column or stack 64 of filing cabinets. The outer ends of tracks 58 are secured to their associated stacks 64 of filing cabinets in a manner corresponding to that shown in FIGS. 12 and 13. However, it is not necessary to employ the vertical struts 38.

From the foregoing it will be readily evident that there has been provided an improved compact storage assembly capable of providing ready access to a substantial number of articles carried on shelves.

I claim:

1. A storage assembly comprising a protective cabinet adapted to be self-standing on a support surface, a plurality of substantially parallel tracks carried by and adjacent the top of said cabinet to protrude forwardly beyond the front of said cabinet, means standing on said support surface and disposed to extend upwardly therefrom to support the outer ends of said tracks from beneath, a plurality of storage panel assemblies for storing articles therein, said assemblies including and being carried by rollers riding along said tracks so as to hang therefrom and be movable individually therealong, said assemblies being movable between stored and withdrawn positions within and with respect to said cabinet, said panel assemblies being formed to include an elongate rigid member defining the bottom edge thereof, means for guiding said bottom edge during movement of said panels between stored and withdrawn positions, the degree to which said tracks protrude serving to permit the panel assemblies, including said rollers, carried by said tracks to be substantially fully withdrawn to substantially fully expose the sides thereof to provide access to articles carried by each withdrawn panel, said bottom edge extending rearwardly beyond the panel assembly to remain engaged by said means for guiding said edge after said panel assembly has been substantially fully exposed, said continued engagement serving to inhibit lateral swaying of said withdrawn panel assembly.

2. A storage assembly according to claim 1 in which said means supporting the outer ends of said tracks includes storage cabinet means.

3. A storage assembly comprising a pair of protective cabinets, each of said cabinets having a top, back and sides and open at the front, the fronts of said cabinets being disposed in confronting relation, a plurality of substantially parallel tracks carried by and adjacent the tops of said cabinets to extend therebetween, a plurality of storage panel assemblies for carrying articles therein, said storage panel assemblies being rollably carried by said tracks to move individually therealong between stored and withdrawn positions with respect to an associated cabinet, each said track being shared by a storage panel assembly from both said cabinets, the spacing between said cabinets being sufficient to permit said panel assemblies thereof to be withdrawn to a degree exposing substantially all the articles carried by same when fully loaded, and means carried by said tracks serving to prevent said panel assemblies from fully leaving their associated cabinet when withdrawn and for preventing said panel assemblies from engaging the back of their associated cabinets when stored, the last named said means being adjustably movable along said tracks to adjust the clearance between said back and said panel assembly when fully inserted into said cabinet and also serving to adjust the degree to which said panel assembly may be withdrawn.

4. A storage assembly as in claim 3 in which said panel assemblies have a height, thickness and width, the width of said panels being less than the depth of said cabinets measured from front to back thereof, said panel assemblies including means defining a bottom edge thereof, and means for guiding the bottom edge of each panel assembly during movement between stored and withdrawn positions, said bottom edge of said storage panel assemblies being formed to extend rearwardly beyond the width of said panel assemblies to remain engaged with said guiding means when substantially fully withdrawn to prevent said panel assemblies from swaying laterally while substantially fully withdrawn.

5. A storage assembly as in claim 4 further comprising adjustable stop means carried by said tracks for arresting said panel assemblies at both ends of their travel in a manner preventing an associated panel assembly from fully leaving said guiding means when being withdrawn and preventing said rearwardly extending portion from engaging the back wall of said cabinet when stored.

6. In a storage assembly as in claim 3 in which said storage panel assemblies include a rectangular frame comprised of a pair of hollow uprights and a pair of transverse members joining said uprights, said uprights being open at their upper ends, a hanger assembly inserted into each of the open upper ends of said uprights, said hanger assemblies carrying rollers to ride within an associated one of said tracks, and means for readily releasably coupling said hanger assemblies to said uprights.

7. In a storage assembly as in claim 6 in which the last-named means comprises a pair of aligned openings formed through said uprights adjacent the upper ends thereof, an opening formed through said hanger assembly adapted to be aligned with said pair of openings, and a retaining pin insertable through all said openings to secure said hanger assemblies to said frame.

8. In a storage assembly the combination comprising a protective cabinet adapted to be self-standing on a support surface and having top, bottom and side walls and open at the front and back, a plurality of substantially parallel tracks carried by and adjacent said top wall to extend in opposite directions from the front and back of said cabinet, a plurality of storage panel assemblies for carrying articles therein, said storage panel assemblies being carried by rollers riding along said tracks, said storage panel assemblies being carried to hang from and to move individually along an associated track from a stored position within said cabinet to a withdrawn position at either the front or the back of the cabinet, the degree to which said tracks extend from the front and back of said cabinet serving to permit said panel assemblies to be withdrawn to a degre substantially fully exposing all articles carried by same when fully loaded, said storage panel assemblies including front and back frame members, detent means in said tracks for engaging said rollers and serving to retain said panel assemblies within said cabinet with said front and back frame members aligned, and means carried on both the front and back of said storage panel assemblies for withdrawing the panel assemblies from the front or the back of said cabinet.

9. A storage assembly as in claim 8 comprising means standing on the support surface and extending upwardly therefrom to support the outer ends of said tracks from beneath and at a height permitting personnel to walk thereunder in an upright position.

* * * * *